US011105559B2

(12) United States Patent
Okubo et al.

(10) Patent No.: US 11,105,559 B2
(45) Date of Patent: Aug. 31, 2021

(54) DRAWN CUP-TYPE HEAT EXCHANGER

(71) Applicant: T.RAD Co., Ltd., Tokyo (JP)

(72) Inventors: Atsushi Okubo, Tokyo (JP); Taiji Sakai, Tokyo (JP)

(73) Assignee: T.RAD CO., LTD., Tokyo (JP)

( * ) Notice: Subject to any disclaimer, the term of this patent is extended or adjusted under 35 U.S.C. 154(b) by 133 days.

(21) Appl. No.: 16/488,160

(22) PCT Filed: Feb. 28, 2018

(86) PCT No.: PCT/JP2018/008878
§ 371 (c)(1),
(2) Date: Aug. 22, 2019

(87) PCT Pub. No.: WO2018/159859
PCT Pub. Date: Sep. 7, 2018

(65) Prior Publication Data

US 2020/0033065 A1 Jan. 30, 2020

(30) Foreign Application Priority Data

Mar. 3, 2017 (JP) ..... JP2017-040870

(51) Int. Cl.
*F28F 3/06* (2006.01)
*F28D 9/00* (2006.01)
(Continued)

(52) U.S. Cl.
CPC ..... *F28D 9/00* (2013.01); *F28F 3/06* (2013.01); *F28D 2021/0089* (2013.01);
(Continued)

(58) Field of Classification Search
CPC ..... F28D 9/00; F28D 9/0075; F28D 9/005; F28D 2021/0089; F28F 3/10; F28F 2275/04
See application file for complete search history.

(56) References Cited

U.S. PATENT DOCUMENTS 4,718,484 A * 1/1988 Hoeffken ..... F28F 3/10 165/170
5,186,250 A * 2/1993 Ouchi ..... F28D 1/0316 165/152
(Continued)

FOREIGN PATENT DOCUMENTS

JP 61-115879 U 7/1986
JP 06-022770 U 3/1994
(Continued)

*Primary Examiner* — Devon Russell
(74) *Attorney, Agent, or Firm* — Norris McLaughlin, P.A.

(57) ABSTRACT

A structure of a drawn cup-type heat exchanger of improved pressure tightness is provided. A drawn cup-type heat exchanger is configured by stacking in plural number a long and thin tube element containing an inner fin inside a pair of cup plates. The cup plates have a flat containing portion containing the inner fin and a pair of cup portions communicating with both end portions of the containing portion; a circulation hole for communicating fluid into each of tube elements to be stacked is formed in the cup portions; and, to position both end portions in a longitudinal direction of the inner fin to be contained in front of the circulation hole of the cup portions, a corner portion is formed at at least one end portion in a width direction at both extremities in a longitudinal direction of the containing portion.

1 Claim, 8 Drawing Sheets

(51) Int. Cl.

| | |
|---|---|
| *F28D 21/00* | (2006.01) |
| *F28F 3/08* | (2006.01) |
| *F28F 9/00* | (2006.01) |

(52) U.S. Cl.
CPC . *F28F 3/08* (2013.01); *F28F 9/00* (2013.01); *F28F 2225/08* (2013.01)

(56) References Cited

U.S. PATENT DOCUMENTS

| | | | | |
|---|---|---|---|---|
| 5,195,580 | A * | 3/1993 | Hoeffken | B21D 39/02 165/170 |
| 6,668,916 | B2 * | 12/2003 | Zobel | F28F 9/0221 165/173 |
| 8,002,022 | B2 * | 8/2011 | Geskes | F28F 9/02 165/157 |
| 2005/0006078 | A1 | 1/2005 | Jeong | |
| 2009/0126911 | A1 | 5/2009 | Shore et al. | |
| 2015/0285572 | A1 * | 10/2015 | Fleitling | F28F 3/025 165/167 |
| 2016/0223272 | A1 * | 8/2016 | Nakamura | F28F 9/0221 |
| 2016/0320139 | A1 * | 11/2016 | Nakamura | F28D 7/1684 |
| 2017/0176047 | A1 * | 6/2017 | Kondo | B23P 15/26 |
| 2019/0257596 | A1 * | 8/2019 | Sharma | F28F 21/084 |

FOREIGN PATENT DOCUMENTS

| | | | |
|---|---|---|---|
| JP | 2000-018872 | A | 1/2000 |
| JP | 2000-074591 | A | 3/2000 |
| JP | 2005-016711 | A | 1/2005 |
| KR | 10-0527723 | B1 | 11/2005 |
| KR | 10-2010-0000691 | A | 1/2010 |

* cited by examiner

DRAWN CUP-TYPE HEAT EXCHANGER

TECHNICAL FIELD

The present invention relates to a drawn cup-type heat exchanger configured by stacking in plural number a tube element containing an inner fin inside a pair of cup plates.

BACKGROUND ART

Heat exchangers such as an oil cooler is utilized, for example, when an engine oil of an automobile is cooled with cooling water. As a heat exchanger, a heat exchanger of a drawn cup-type, which is configured by stacking in plural number a tube element containing an inner fin inside a pair of cup plates, is employed in many cases.

In FIG. 10, FIG. 11, there is shown an example of conventional usual tube element for use in a heat exchanger of a drawn cup-type. FIG. 10 illustrates a partial cross-sectional view showing a part of the tube element, and FIG. 11 illustrates a XI-XI arrow-seen plan view in FIG. 10.

In FIG. 10, FIG. 11, a long and thin tube element 1 is formed by brazing and joining rims of a pair of cup plates 2*a*, 2*b* that are disposed facing each other, and, in the internal space thereof, an inner fin 3 of an offset-type is contained. These cup plates 2*a*, 2*b* have a flat, long and thin containing portion 4 that contains the inner fin 3, and a cup portion 5 at both end portions of the containing portion 4. For the cup portion 5, a circulation hole 6 for causing fluid to communicate into each of the stacked tube elements 1 is formed.

Plural tube elements 1 are joined each other in a stacked state to form a core portion of the heat exchanger.

In FIG. 10, there is exemplified only the tube element 1 on the lowermost layer and a second tube element 1 stacked on the upper portion thereof. A third one and later are sequentially stacked in the same way in a range shown by a dashed one-dotted line, and furthermore an outer fin 7 is arranged between respective tube elements 1. Note that the tube element 1 on the lowermost layer is formed with the cup plate 2*a* on the upper side and with a bottom plate 8 on the lower side.

At both end portions in the longitudinal direction of the containing portion 4 of each of cup plates 2*a*, 2*b*, a pair of rectangular-circular cup portions 5 communicating in the stack direction are formed, and as shown in FIG. 10 the peripheral part thereof is raised by one step to form a step portion 5*a*. At the periphery of the step portion 5*a*, a small flange portion for joining, which extends horizontally and is even, is formed.

SUMMARY OF INVENTION

Technical Problem

In a case where stacked plural tube elements 1 are joined each other by brazing or the like to form a core portion of a heat exchanger, each of cup plates 2*a*, 2*b*, an inner fin 3 and an outer fin 7 are also joined at the same time. By joining the inner fin 3, whose entire shape in a plane is flat, with an internal surface of containing portions 4 of cup plates 2*a*, 2*b*, the upper surface thereof and the lower surface thereof facing each other, the whole of the tube element 1 is reinforced and pressure resistance strength is secured. For that purpose, it is necessary that each of these parts are arranged at predetermined mutual relative positions and are entirely joined while keeping the arranged state.

However, slight displacement often occurs in a temporary assembling process or a joining process. Displacement that occurs when the inner fin 3 is joined, in particular, affects the performance of an exchanger and largely affects the compressive strength thereof.

Therefore, until now, to prevent displacement of the inner fin 3 to be set to the cup plates 2*a*, 2*b*, a method is employed in which a dowel to be an obstacle for preventing movement is set up on a cup 5 side of the containing portion 4 in the cup plates 2*a*, 2*b* so that movement of the inner fin 3 toward a cup portion 5 side is prevented with the dowel.

However, the dowel position is at an inner side of the extremity in the longitudinal direction of the containing portion 4 and, on a side nearer to the extremity, there is no joining between an inner surface of the containing portion 4 and the upper/lower surface of the inner fin 3, and the strength of the entire tube element 1 is reduced and the pressure resistance strength is reduced.

In other words, the presence of this unjoined part increases the amount of change in shape relative to inner pressure and, since stress concentrates to the dowel fixed to the cup plates 2*a*, 2*b*, it is difficult to secure pressure resistance strength, particularly, in a heat exchanger for which a high specification about pressure proof is demanded.

To avoid this problem, one possible solution is to make the thickness of the cup plates 2*a*, 2*b* and/or the outer fin 7 larger, but this will bring about other problems such as weight increase and cost increase.

To join the cup plates 2*a*, 2*b* each other, if a small flange portion is formed on a periphery of the cup plate, in a case where the requirement is to secure the opening area of a circulation hole, the whole of a heat exchanger increases in size by the small flange portion. On the other hand, in a case where the requirement is to avoid the increase in size, the opening area of the circulation hole decreases by the small flange portion to increase circulation resistance to fluid.

Consequently, the present invention aims at providing a new heat exchanger with which these problems have been solved.

Solution to Problem

A first invention of the present inventions is a drawn cup-type heat exchanger configured by stacking in plural number a long and thin tube element containing an inner fin inside a pair of cup plates, in which the cup plates have a flat containing portion containing the inner fin and a pair of cup portions provided at both end portions of the containing portion; a circulation hole for communicating fluid into each of tube elements to be stacked is formed in the cup portions; and, to position both end portions of the inner fin to be contained in front of the circulation hole of the cup portions, a corner portion is formed at least one end portion in a width direction at both extremities in a longitudinal direction of the containing portion (claim 1).

In a second invention of the present inventions, in the first invention, the corner portion is configured so that the inner fin can be positioned in a state where an end portion thereof projects into an inside of the cup portion (claim 2).

In a third invention of the present inventions, in the first invention or in the second invention, cup portions in the pair of cup plates facing each other are joined in a state where side faces of circulation holes along a circulation direction in respective cup portions overlap each other (claim 3).

In a fourth invention of the present inventions, in the third invention, an end portion of a side face of the cup plate 2*a* lying on the inside in the overlap does not project, exceeding a height of the inner fin, into the other cup plate 2*b* side in a state where the pair of cup plates 2*a*, 2*b* and the inner fin have been combined (claim 4).

In a fifth invention of the present inventions, in the fourth invention, a step portion is formed on the side face of the cup plate lying on the outside in the overlap and an end portion of the side face rising from the step portion is expanded outward, and joining has been performed in a state where an end portion of the side face of the cup plate lying on the inside in the overlap is in contact with a bottom surface of at least a part of the step portions (claim 5).

Advantageous Effects of Invention

In the first invention, a corner portion 9 is formed, to position both end portions of an inner fin to be contained in a containing portion in front of circulation holes of the cup portion 5 of cup plates 2*a*, 2*b*, at at least one end portion in a width direction at both extremities in a longitudinal direction of the containing portion. As a consequence of this configuration, it is unnecessary to provide an obstacle such as a dowel inside the containing portion 4, and, by matching both end portions of the inner fin 3 with the corner portions 9 lying at the extremities of the containing portion 4, the inner fin 3 and the cup plates 2*a*, 2*b* can be positioned each other. Consequently, since parts not joined with the inner fin in a cup plate decrease, pressure tightness of the tube element 1 is improved and reduction in thickness of respective parts configuring the tube element 1 is possible.

In the second invention, the extremity of the inner fin 3 is projected into the inside of the cup portion 5 in a state where the end portion of an inner fin is abutted on the corner portion of the cup plates 2*a*, 2*b*. As a consequence of the configuration, a joining portion between the cup plates 2*a*, 2*b* and the inner fin 3 is broadened to improve the joining strength, and pressure tightness can be secured more certainly.

In the third invention, the joining between the cup portions 5 in a pair of cup plates 2*a*, 2*b* facing each other is performed in a state where a side face 10 along a circulation direction of the circulation hole in respective cup portions 5 overlap each other. As a consequence of this configuration, the small flange portion is unnecessary and, therefore, the opening area of the circulation hole can be secured without increasing the size of a heat exchanger.

In the fourth invention, the end portion of the side face 10 of the cup plate 2*a* lying on the inside in the overlap does not project into the other cup plate 2*b* side exceeding the height of the inner fin 3. As a consequence of this configuration, it is possible to conform the end face of the side face 10 of the cup plate 2*a* to the end face of the side face 10 of the containing portion 4 to make these uniform on an approximately the same plane over the entire circumference of the cup plate 2*a* to thereby improve molding processability and a material yield by press processing of the cup plate 2*a*.

In the fifth invention, a step portion is formed on the side face of the cup plate lying on the outside in the overlap and the end portion of a side face rising from the step portion is expanded outward, and joining has been performed in a state where an end portion of the side face of the cup plate lying on the inside in the overlap is in contact with a bottom surface of at least a part of the step portions. As a consequence of this expansion, the part functions as a guide when both cup plates are made to fit and the fitting is easy to improve workability. Moreover, by configuring so that joining such as brazing is performed in a state where the end portion of the other cup plate is in contact with the bottom surface of at least a part of step portions 11, even when a compressive load is applied in the stacking direction of respective cup plates 2*a*, 2*b* in a joining process, the load is supported with the step portion 11 to join soundly and airtightly the cup plates 2*a*, 2*b* paired vertically without generating displacement and/or deformation of the fitting portion.

DESCRIPTION OF EMBODIMENTS

Figure 1:
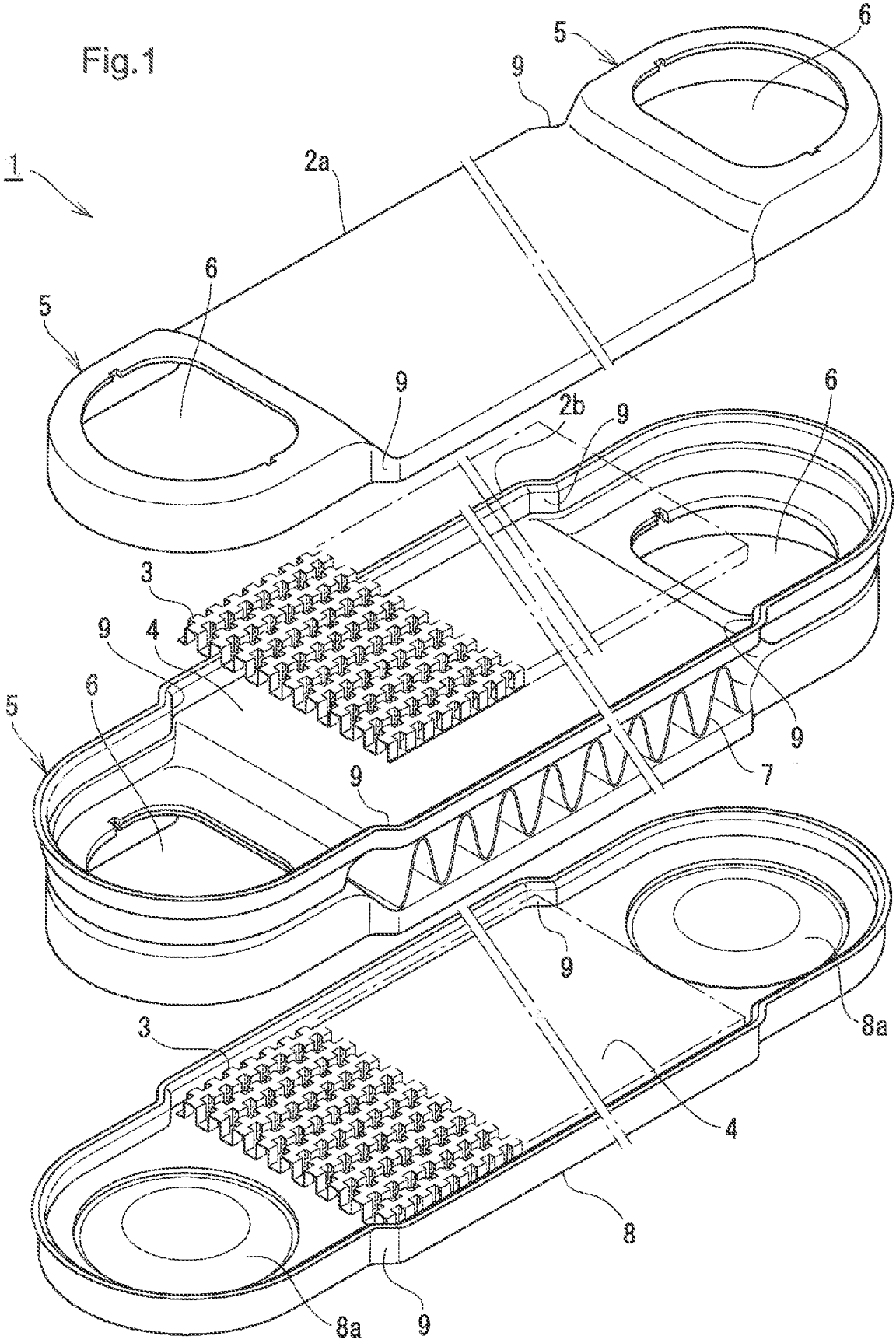
FIG. 1 illustrates a partially exploded perspective view showing in an exploded state a part of plural tube elements to be stacked, in an embodiment of the heat exchanger of the present invention.
Figure 2:
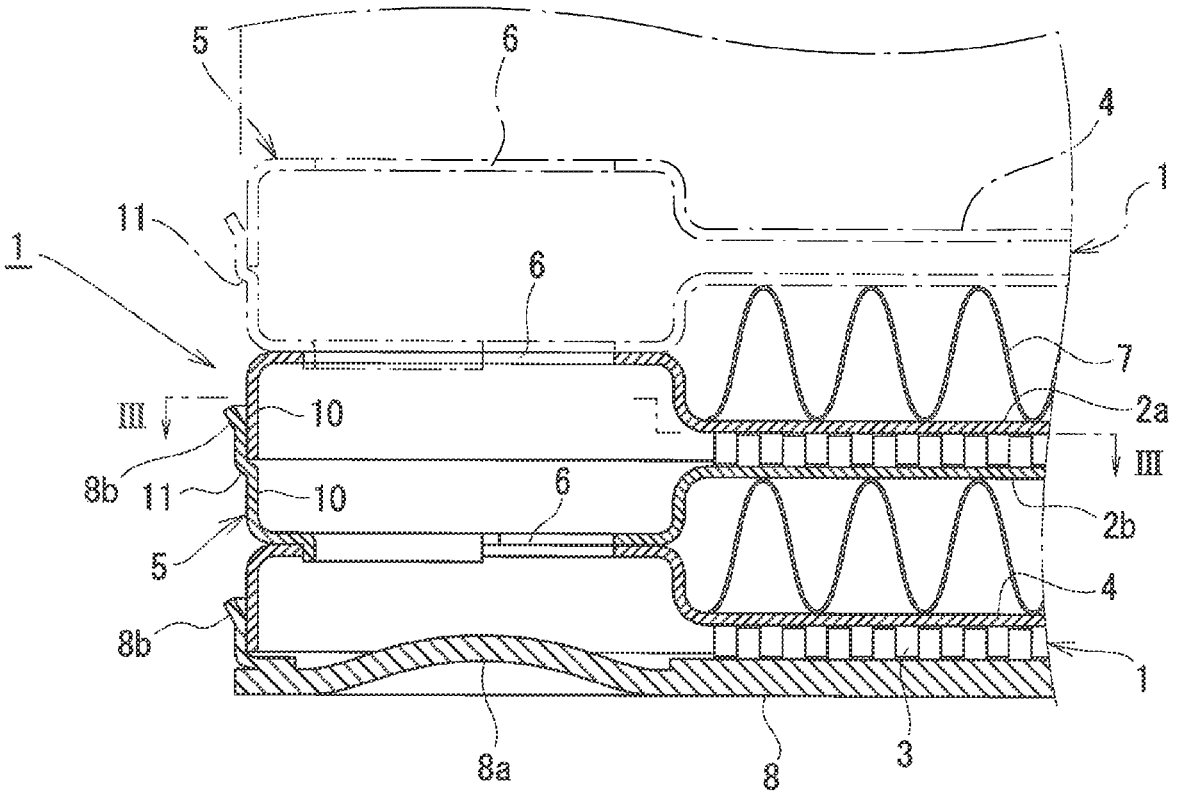
FIG. 2 illustrates a partial side cross-sectional view showing a state where respective tube elements in FIG. 1 are stacked each other.
Figure 3:
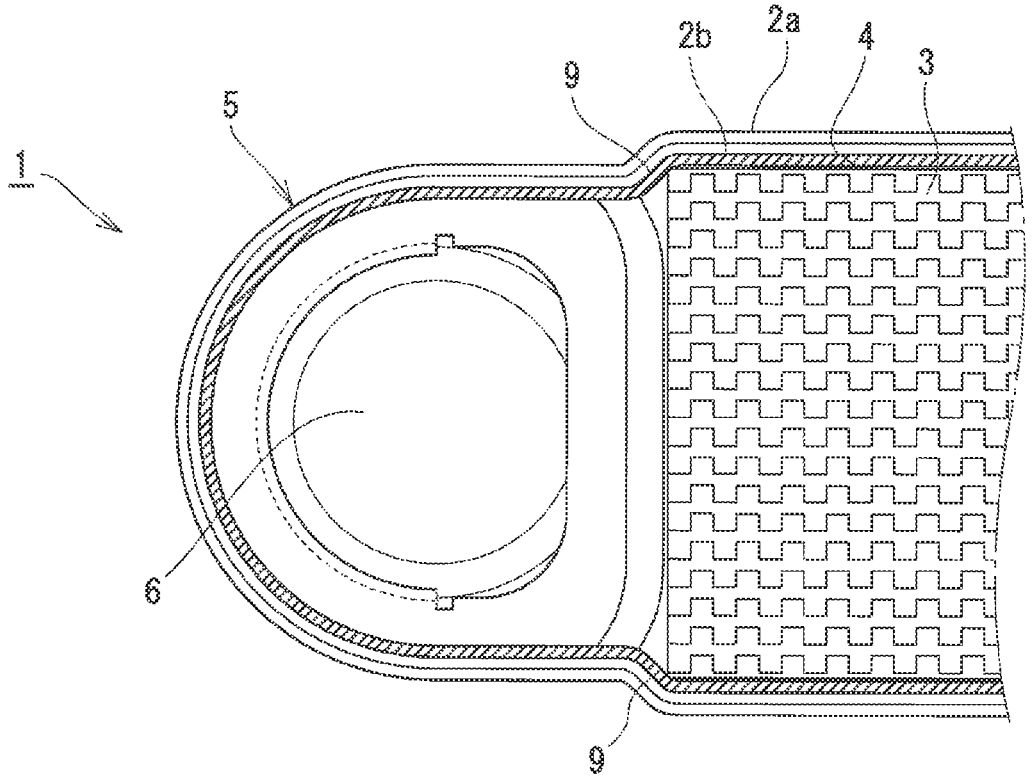
FIG. 3 illustrates a plan cross-sectional view seen along a arrow in FIG. 2.
Figure 10:
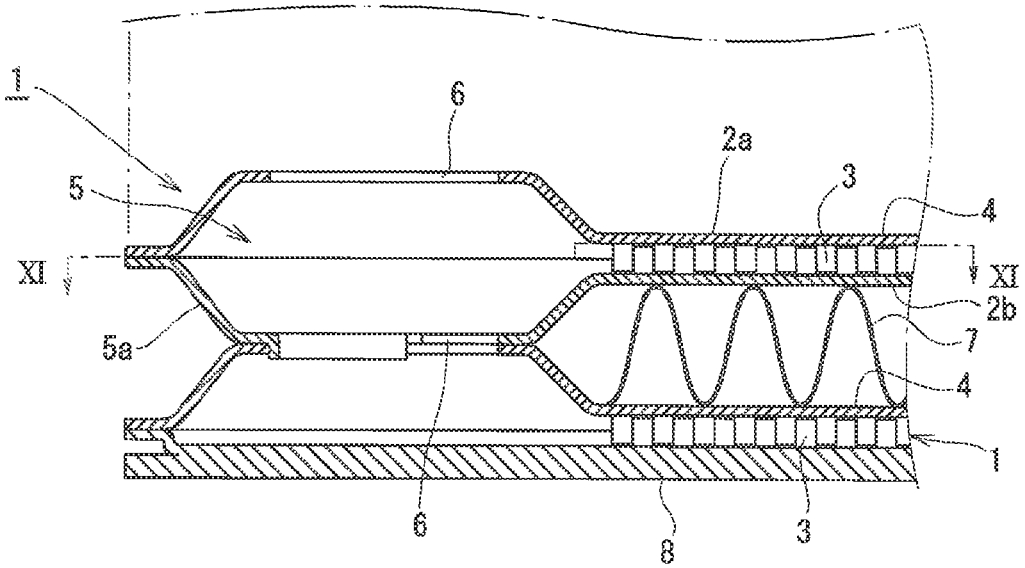
Fig.10 RELATED ART
FIG. 10 illustrates a partial side cross-sectional view showing a state where respective tube elements are stacked each other in a conventional heat exchanger.
Figure 11:
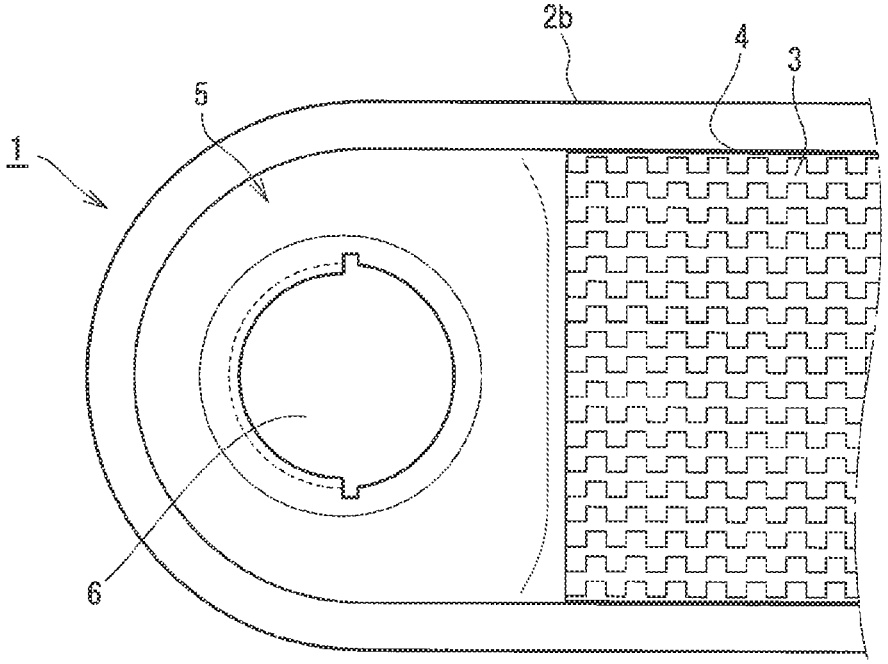
Fig.11 RELATED ART
FIG. 11 illustrates a plan cross-sectional view seen along a VII-VII arrow in FIG. 10.

Next, an embodiment of a tube element that is a component of the heat exchanger of the present invention will be explained on the basis of the drawings. FIG. 1 illustrates a partially exploded perspective view showing in an exploded state a part of plural tube elements to be stacked, and FIG. 2, FIG. 3 illustrate a state where the tube elements 1 in FIG. 1 are stacked. Meanwhile, in a case where respective members in each drawing in embodiments of the present invention are approximately the same as respective members in above-described FIG. 10, FIG. 11, the same symbols as those in FIG. 10, FIG. 11 are given and duplicated explanations will be omitted as far as possible.

In FIG. 1, the tube element 1 is configured of an upper side cup plate 2*a* and a lower side cup plate 2*b*, each of which is long and thin, and an inner fin 3 interposed between both cup plates 2*a*, 2*b*. Then, an outer peripheral edge of the cup plate 2*a* on the upper side is fitted to an inner peripheral of the cup plate 2*b* on the lower side. The peripheral edge of the cup plate 2*b* on the lower side is formed with a step and the outer peripheral edge of the peripheral edge expands outward, an expanding portion 8*b* guiding smoothly an edge portion of the cup plate 2*a* on the upper side. Furthermore, an outer fin 7 is arranged between respective tube elements 1 stacked vertically. Meanwhile, what is shown on the lowermost side is a bottom plate 8, which has the same planar shape as that of the cup plate 2*b* on the lower side. In this example, on a bottom surface of cup portions at both ends in the longitudinal direction of this bottom plate 8, a circular convex portion 8*a* is formed toward the upper direction in the stacking direction, but the circular convex portion 8*a* may be omitted. The cup plates 2*a*, 2*b*, the inner fin 3 and the outer fin 7 have metallic quality of material such as aluminum alloy or stainless steel, and, as to the shape of the inner fin 3, known fins such as an offset fin can be used.

In a state where a pair of cup plates 2*a*, 2*b* are arranged vertically while facing each other, a containing portion 4 having a square shape in plan view is formed at the central portion in the longitudinal direction of these, and at both end portions in the longitudinal direction thereof, a cup portion 5, which has a flat cup-like shape with a rectangular-circular planar shape and a height higher than the containing portion 4, is formed. The inner fin 3 is arranged inside the containing portion 4 of the cup plates 2*a*, 2*b*. Furthermore in the bottom of the cup portion 5, a circulation hole 6 in an approximately circular shape for circulating fluid in the stacking direction is formed. Note that the circulation hole 6 is formed coaxially for each of a vertical pair of the cup plates 2*a*, 2*b*.

The width of the containing portion 4 of the cup plates 2*a*, 2*b* is formed slightly larger than the width of the cup portions 5 communicating with both end portions thereof. Then corner portions 9 are formed in four portions at the boundary between both end portions in the longitudinal direction of the containing portion 4 and the rectangular portion of the rectangular-circular portion of the cup portion 5. In this embodiment, each of the corner portions 9 inclines relative to the longitudinal direction of the cup plates 2*a*, 2*b*, but the corner portion 9 may be formed orthogonally instead of the inclination.

As shown in FIG. 3, both portions in the width direction of extremities in the longitudinal direction of the inner fin 3 is positioned in a state of being in contact with a pair of corner portions 9 of the containing portion 4.

As shown in FIG. 2, the cup portions 5 facing each other are in a state where the side faces 10 along the circulation direction of the circulation hole 6 in respective cup portions 5 overlap each other. In the drawing, a step portion 11 is formed outward on the side face 10 of the cup portion 5 on the lower side, and the end portion of the side face 10 rising from the step portion 11 is expanded outward to form there the expanding portion 8*b*. Moreover, the end portion of the side face 10 of the cup plate 2*a* lying on the inside in the overlap does not project into the other cup plate 2*b* side exceeding the height of the inner fin 3. Note that, in FIG. 1, these step portions 11 and outward expansion of the end portion of the side face 10 are omitted for the purpose of avoiding complication of the drawing.

As a consequence of forming a state where the side faces 10 are overlapped each other as described above, the joining portion between the cup portions 5 is made to be small to configure a compact heat exchanger. Moreover, by expanding outward the end portion of the side face 10 to form the expanding portion 8*b*, it is possible to guide the edge portion of the side face 10 of the cup plate 2*a* on the upper side to the expanding portion 8*b*. Consequently, a fitting operation of the side faces 10 thereof is easy to improve the operating efficiency thereof.

Moreover, since the end portion of the side face 10 of the cup plate 2*a* does not project into the other cup plate 2*b* side exceeding the height of the inner fin 3, it is possible to make the end face of the side face 10 of the cup plate 2*a* even on an approximately the same plane over the entire circumference of the cup plate 2*a*, while making the same conform the end face of the side face 10 in the containing portion 4, to thereby improve molding processability by press processing and a material yield of the cup plate 2*a*.

In a state as positioned in FIG. 2, FIG. 3, each of members configuring the tube element 1, and the outer fin 7 etc. are joined integrally by brazing. In a case where a heat exchanger is configured of an aluminum material, a cladding material covered with a brazing material can be used as a plate.

Figure 4:
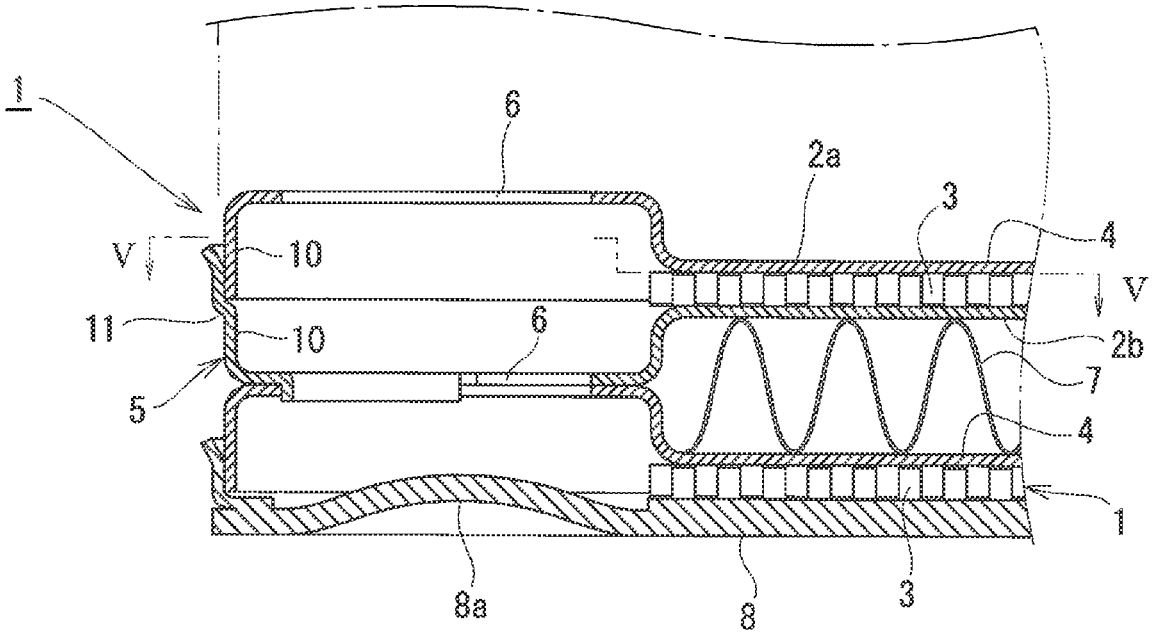
FIG. 4 illustrates a partial side cross-sectional view showing a state where respective tube elements are stacked each other, which is a second embodiment of the heat exchanger of the present invention.
Figure 5:
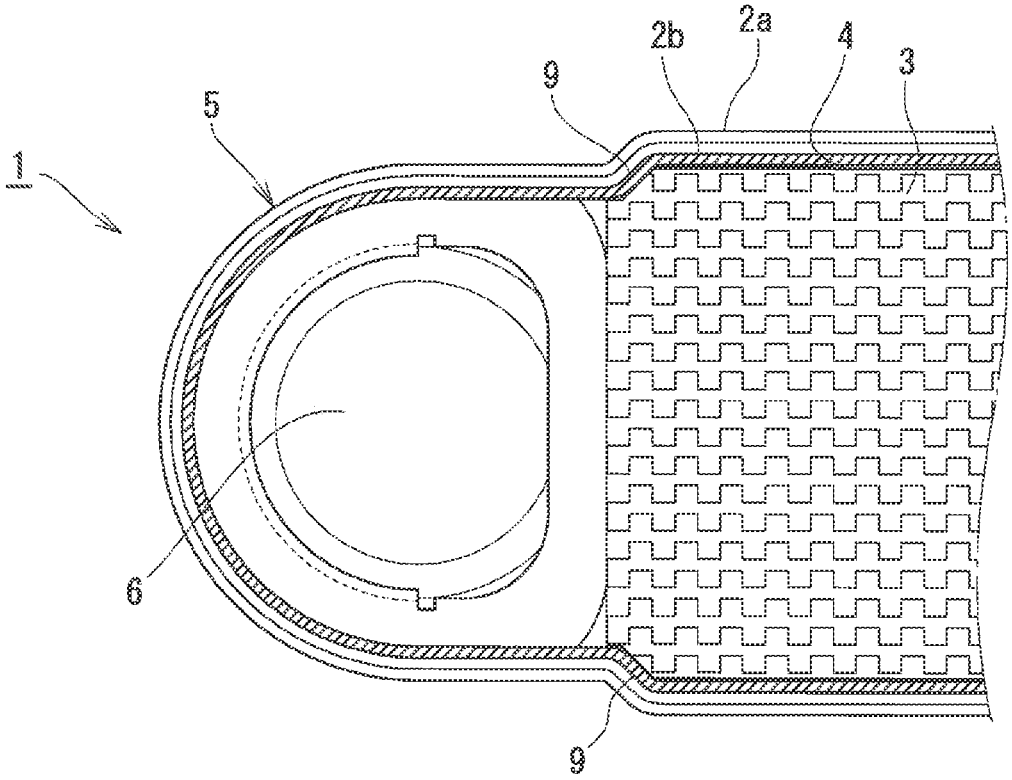
FIG. 5 illustrates a plan cross-sectional view seen along a V-V arrow in FIG. 4.

FIG. 4, FIG. 5 illustrate, in accordance with FIG. 2, FIG. 3, a second embodiment of the tube element 1 in the heat exchanger of the present invention. A different point of this embodiment from the embodiment in FIG. 2, FIG. 3 is that both extremities in the longitudinal direction of the inner fin 3 contained in the containing portion 4 of the tube element 1 slightly project into the inside of the cup portion 5 from the containing portion 4, and the embodiment is formed while other points are in the same way as the above-described Example.

In this embodiment, a length in the longitudinal direction of the inner fin 3 is set to be slightly longer than the length in the longitudinal direction of the containing portion 4. Then as shown in FIG. 4, the extremity of the inner fin 3 projects into the inside of the cup portion 5 by the slightly longer amount. As a consequence of forming a fillet by brazing on the projecting part, joining areas between the cup plates 2*a*, 2*b* and the inner fin 3 increase more and stress concentration at the joining portion is relaxed to thereby improve pressure tightness more. As to the projecting amount, for example, in a case where an offset fin is used for the inner fin 3, several pitches or less of the offset pitch (dimension from a certain offset to the subsequent offset) suffice, and less than one pitch may be acceptable. The projecting part receives pressure of fluid, and therefore an excess projection causes snapping of the inner fin 3 at the part. Meanwhile, as another positioning method, four corners of the inner fin 3 may be formed in a shape conformed to the inclined face of the corner portions 9 of the cup plates 2*a*, 2*b* as shown in FIG. 5 to position the cup plates 2*a*, 2*b* and the inner fin 3 with both inclined faces.

Figure 6:
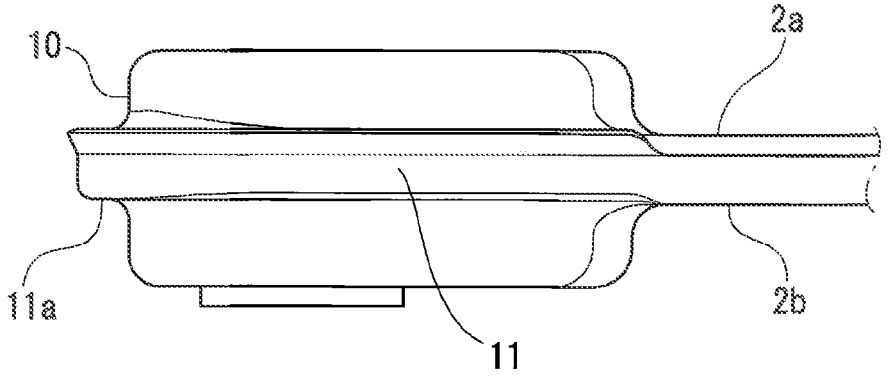
FIG. 6 illustrates a partial side view showing a third embodiment of the present invention.
Figure 7:
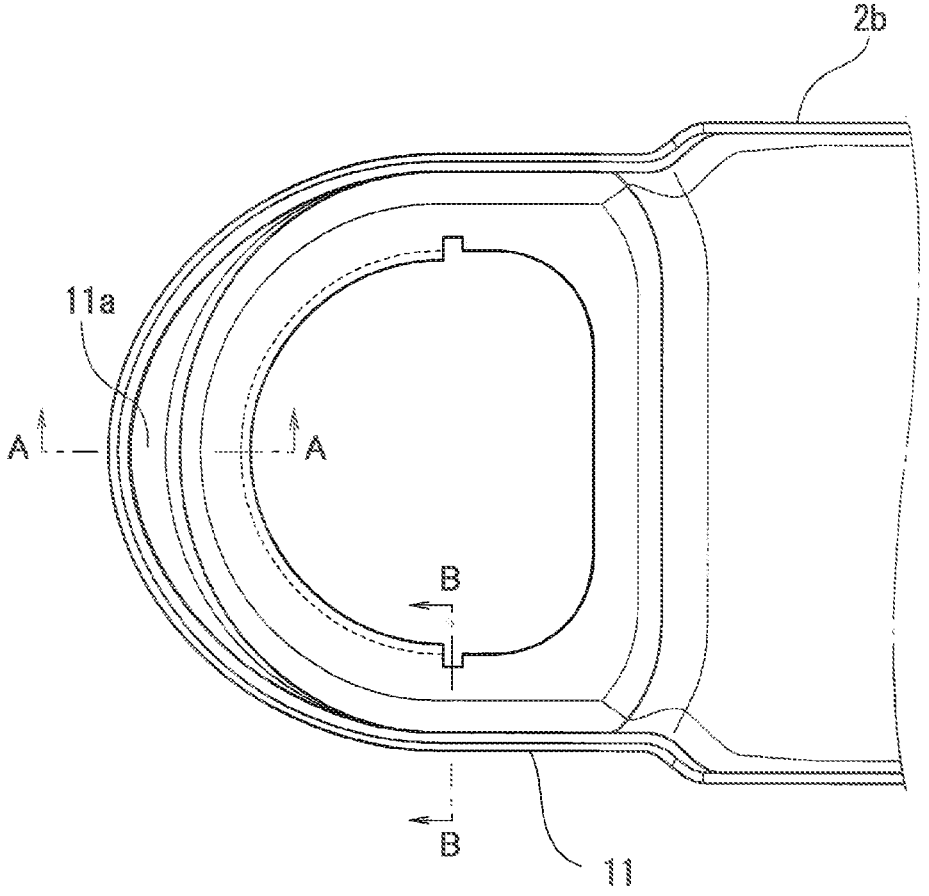
FIG. 7 illustrates a plan view of the same.
Figure 8A:
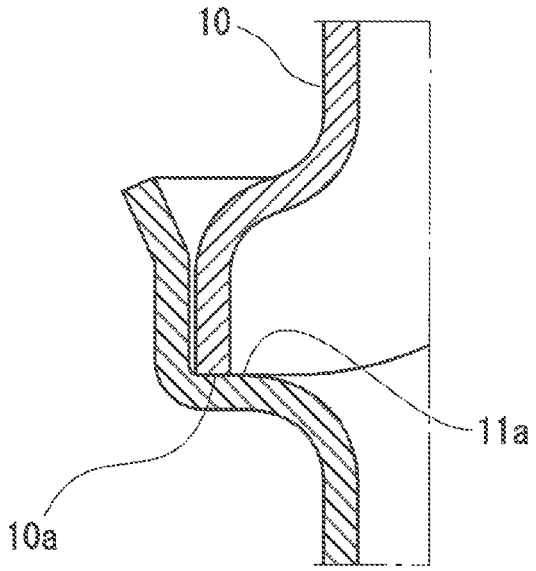
FIGS. 8A and 8B illustrate a principal part-enlarged cross-sectional view of the same.
Figure 8B:
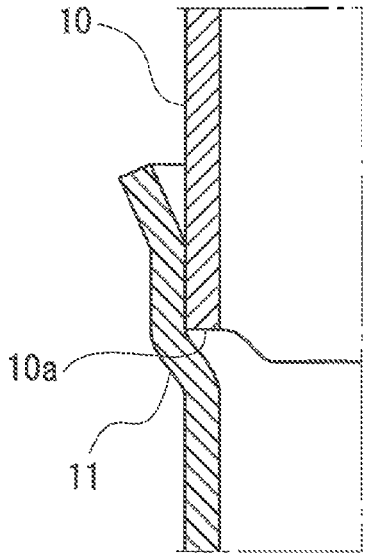
Figure 9:
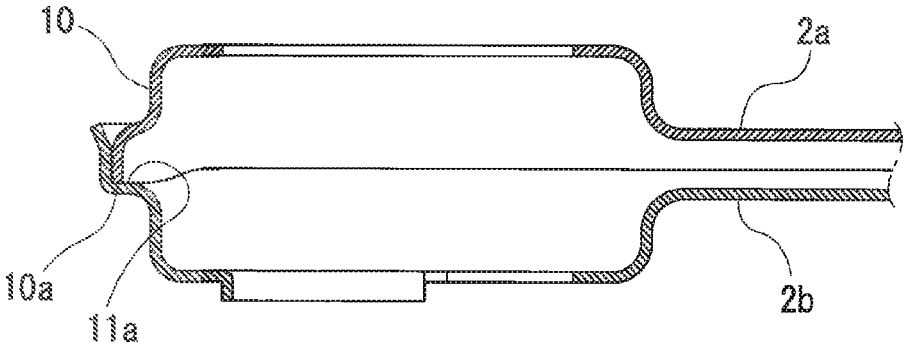
FIG. 9 illustrates a principal part cross-sectional view of the same.

Next, FIG. 6 illustrates a partial side view of a third embodiment of the present invention, FIG. 7 illustrates a plan view of the same, FIGS. 8A, 8B illustrate a principal part-enlarged cross-sectional view of the same, and FIG. 9 illustrates a cross-sectional view along A-A in FIG. 7. Different points of this embodiment from the above-described embodiment are shapes of the step portion 11*a* and the side face 10 seated on it. In the A-A cross-sectional position in FIG. 7, the step portion 11*a* evaginates to the outside in a radius direction and is formed as in FIG. 8A, on which a lower end face 10*a* of the side face 10 of the other cup plate is seated. In this case, the side face 10 evaginates outward so that the lower end face 10*a* thereof is aligned with the step portion 11*a*.

As a consequence of performing joining by brazing in a state where the lower end face 10*a* of the side face 10 of the other cup plate is in contact with the bottom of the step portion 11*a* as described above, even in a case where a compressive load is applied in the stacking direction of each of the cup plates 2*a*, 2*b* to secure the contact of these members in a joining process, the load is supported with the step portion 11*a* so as not to cause displacement or deformation in the fitting portion of the cup plates 2*a*, 2*b* that form vertically a pair with each other.

On the other hand, in the cross-sectional position of B-B in FIG. 7, the step portion 11 is formed, as in FIG. 8B, in the same shape as that in the embodiment in above-described FIG. 4.

As a consequence of forming the step portion 11*a* supporting the load only in a limited vicinity of the extremity in the longitudinal direction of the cup plate in this way, it is possible to make the evagination of the cup plate minimum and to secure sufficiently the opening area of the circulation hole, and a heat exchanger with a small size, low circulation resistance and good assemblability can be provided.

INDUSTRIAL APPLICABILITY

The present invention can be utilized for a heat exchanger of a drawn cup-type such as an oil cooler.

REFERENCE SIGNS LIST

1: tube element
2*a*: cup plate
2*b*: cup plate
3: inner fin
4: containing portion
5: cup portion
5*a*: step portion
6: circulation hole
7: outer fin
8: bottom plate
8*a*: circular convex portion
8*b*: expanding portion
9: corner portion
10: side face
10*a*: lower end face
11: step portion
11*a*: step portion

The invention claimed is:

1. A drawn cup-type heat exchanger configured by stacking a plurality of a long and thin tube elements each containing an inner fin inside a pair of cup plates, wherein each of the cup plates has a flat containing portion containing the inner fin and a pair of cup portions communicating with both end portions of the containing portion; a circulation hole is formed in each of the cup portions for communicating fluid into each of the tube elements; and, to position both end portions in a longitudinal direction of the inner fin so as to contain the inner fin in the containing portion in front of the circulation hole of the cup portions, a corner portion is formed at at least one end portion in a width direction at both extremities in a longitudinal direction of the containing portion;

wherein side walls of the cup portions of adjacent ones of the cup plates overlap so that there are outer side walls and inner side walls and pairs of the adjacent cup plates having overlapping side walls form respective ones of the tube elements;

wherein a height of the inner side wall of each overlapping pair of the side walls does not exceed a height of the inner fin contained in the tube element formed by the cup plates having the overlapping pair of the side walls;

wherein a step is formed on an inner face of the outer side wall of each overlapping pair of the side walls by an outward bend formed on the outer side wall, and a free edge of the inner side wall of the overlapping pair of the side walls is in contact with at least a part of the outward bend forming the step; and wherein the outward bend forming the step on the inner face of the outer side wall with which the free edge of the inner side wall is in contact is only at longitudinal extremities of the cup plates.

* * * * *